United States Patent [19]

Ohmori

[11] 4,158,429

[45] Jun. 19, 1979

[54] APPARATUS FOR FEEDING ELONGATE SHEET MATERIALS

[75] Inventor: Koichiro Ohmori, Tokyo, Japan

[73] Assignee: Honshyuseishi Kabushiki Kaishya, Tokyo, Japan

[21] Appl. No.: 782,227

[22] Filed: Mar. 28, 1977

[51] Int. Cl.[2] ..... B65H 23/18; B65H 17/20

[52] U.S. Cl. ..... 226/34; 226/175; 226/177; 226/178; 226/186; 226/191; 226/194

[58] Field of Search ..... 226/29, 30, 34, 175, 226/176, 177, 178, 183, 186, 28, 191, 194, 187, 174; 271/273, 274; 83/298, 367, 312

[56] References Cited

U.S. PATENT DOCUMENTS

| | | | |
|---|---|---|---|
| 2,359,856 | 10/1944 | Morse | 271/125 |
| 2,796,781 | 6/1957 | Mills | 226/176 X |
| 3,077,293 | 2/1963 | Watkins | 226/186 |
| 3,093,284 | 6/1963 | Mullin | 226/176 |
| 3,283,629 | 11/1966 | Huck | 83/367 X |
| 3,899,945 | 8/1975 | Garrett et al. | 83/346 X |
| 3,899,946 | 8/1975 | Niepmann | 226/191 X |

FOREIGN PATENT DOCUMENTS

| | | | |
|---|---|---|---|
| 490305 | 8/1938 | United Kingdom | 226/34 |
| 684234 | 12/1952 | United Kingdom | 226/30 |

*Primary Examiner*—Bruce H. Stoner, Jr.
*Attorney, Agent, or Firm*—Lane, Aitken & Ziems

[57] ABSTRACT

There is disclosed an apparatus for feeding an elongate sheet material comprising a drive roller driven to rotate at a constant speed, a pressure roller rotatable in rolling contact with the drive roller, the drive roller being formed of a more resilient material than the pressure roller, the pressure roller when biased against the drive roller deforms the peripheral surface of the drive roller in contact with the elongate sheet material sandwiched between said rollers. Provision is made for changing the force of contact between said drive and pressure rollers, whereby the peripheral surface of the drive roller is varied in size thereby changing the peripheral speed of said drive roller and the speed of travel of the elongate sheet material.

4 Claims, 7 Drawing Figures

APPARATUS FOR FEEDING ELONGATE SHEET MATERIALS

FIELD OF THE INVENTION

This invention relates generally to apparatus for feeding elongate sheet materials, and more particularly to such an apparatus having means for controlling the speed of travel of the elongate sheet materials.

BACKGROUND OF THE INVENTION

Elongate sheet members such as paperboards, corrugated cardboards, polyethylene sheets, aluminum foil, and the like are frequently printed, punched, or vacuum-formed in succession. One common form of apparatus for sequentially cutting or shaping elongate sheet materials comprises feed means including a drive roller and an idler roller rotatable in contact with the drive roller, and a processing machine such as a punch and die, the rollers sandwiching a continuous sheet therebetween to feed the continuous sheet from a roll to the processing machine.

Frequently, it is required that the speed of travel of the sheet material be controlled so as to be held in timed relation with the operation of the processing machine. For example, the processing machine may stamp out the sheet sequentially in conformity with patterns printed on the sheet at spaced locations therealong. Another example is a multicolor rotary printing press which prints further patterns successively in precise registry with existing patterns on the elongate sheet. One known technique for changing the speed of travel of the sheet is to provide a speed change gear in a drive mechanism for varying the speed of rotation of the drive roller. This prior art approach is however disadvantageous in that the drive mechanism is of complicated construction and is expensive accordingly. Furthermore, the speed of travel of continuous sheet cannot be changed rapidly and fine adjustment of the speed is difficult to achieve.

SUMMARY OF THE INVENTION

The present invention seeks to provide an elongate sheet feeding apparatus with means for controlling the speed of travel of the sheet, which means is simple in structure.

The invention also seeks to provide such means for gradually changing and finely adjusting the speed of travel of the continuous sheet.

The invention further seeks to provide such speed control means which comprises a drive roller and a pressure roller that, when actuated, bears against a continuous sheet and the drive roller, the drive roller being made of a more resilient material than the pressure roller, and the force of contact between the drive and pressure rollers being variable.

The invention still further seeks to provide a variety of devices for varying the distance between the axes of drive and pressure rollers.

The invention yet further seeks to provide means for automatically changing the interaxial distance between the rollers to control the speed of travel of a continuous sheet fed to a processing station.

According to the invention, there is provided an apparatus for feeding an elongate sheet material including: a drive roller driven to rotate at a constant speed and a pressure roller rotatable by contact with the drive roller. The drive roller is formed of a more resilient material than the pressure roller, so that the pressure roller when held against the drive roller provides a deformed peripheral surface at the point of contact with the elongate sheet material sandwiched between the rollers. Provision is made for changing the force of contact between the drive and pressure rollers, so that the peripheral surface of said drive roller will vary in size to change the peripheral speed of said drive roller, thereby varying the speed of travel of the elongate sheet material.

Other objects and advantages of this invention will be apparent to those skilled in the art from the following detailed description of preferred embodiments thereof, with reference being made to the accompanying drawings, wherein.

Figure 1:
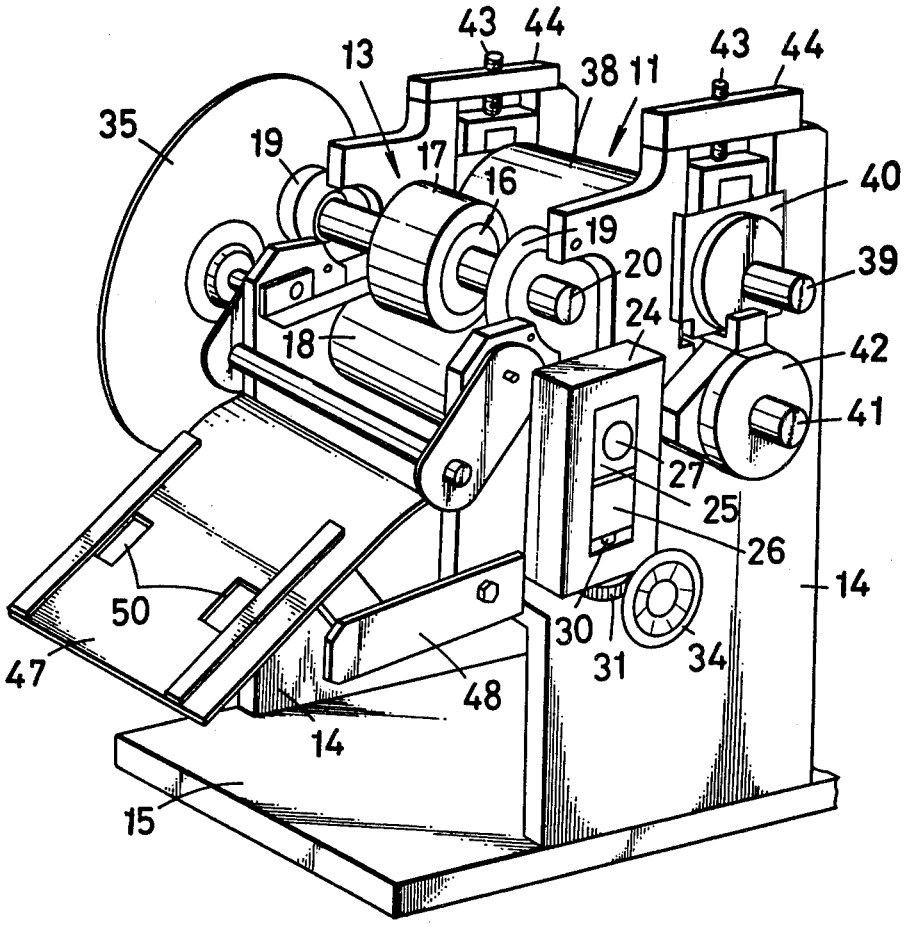
FIG. 1 is a perspective view of an apparatus for feeding elongate sheet materials which is constructed in accordance with this invention.
Figure 2:
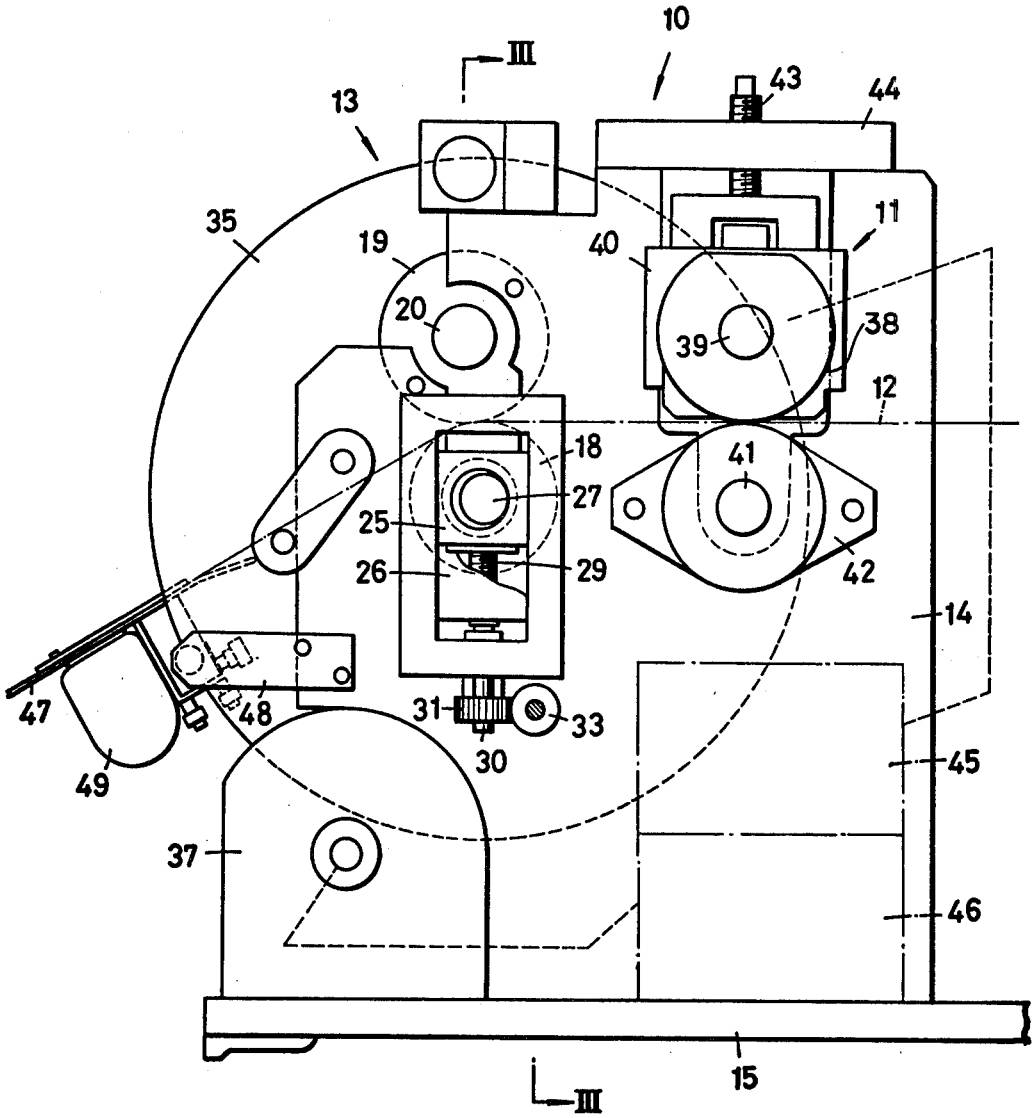
FIG. 2 is an enlarged side elevational view of the apparatus shown in FIG. 1.
Figure 3:
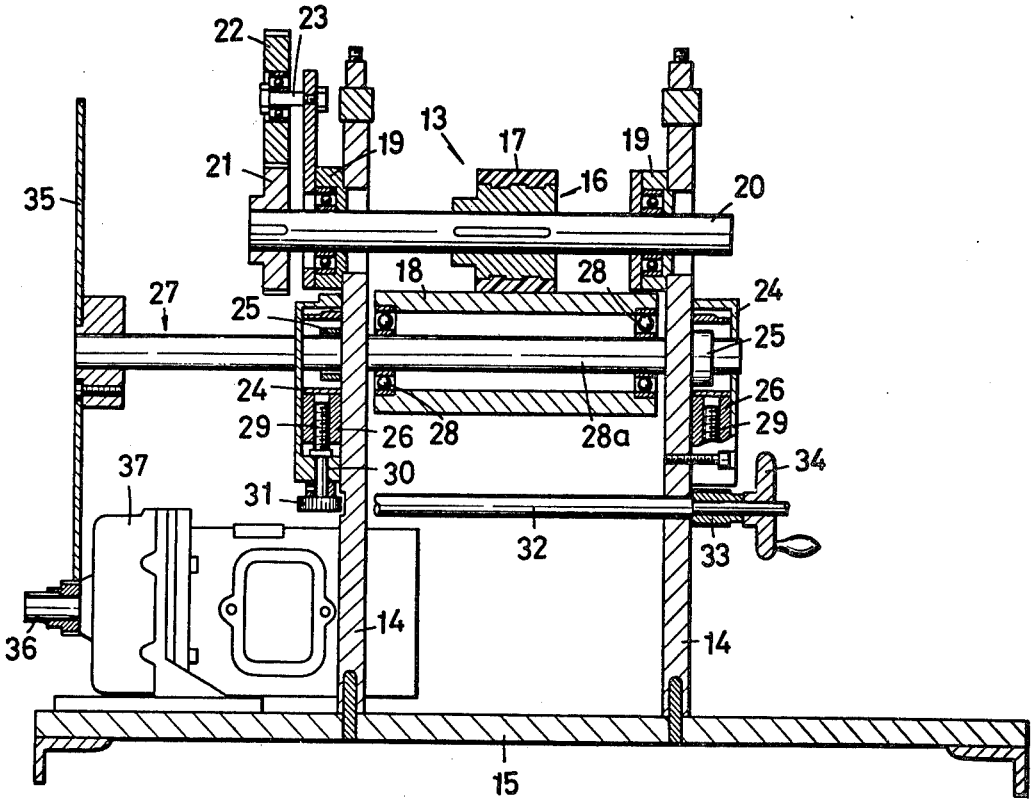
FIG. 3 is a vertical cross-sectional view, on a reduced scale, taken along line III—III of FIG. 2.

Referring now to FIGS. 1 to 3, there is shown a die roll machine generally designated 10 and including a die roll station 11 for stamping out an elongate sheet material 12 sequentially and an apparatus 13 for feeding the elongate sheet material 12 from a roll (not shown) to the die roll station 11. The machine 10 has a pair of vertically extending side frames 14 supported on a platform 15 for mounting on a suitable foundation (not shown). The feeding apparatus 13 comprises a drive roller 16 having on its periphery a cover 17 formed of a relatively deformable material such as flexible plastic or soft rubber and a pressure or pinch roller 18 formed of a relatively indeformable material such as hard rubber, rigid plastic or metal and rotatable in contact with the drive roller 16. The frames 14 have at their upper portions a pair of ball bearings 19 in which there is journaled an axle 20 having on its central portion the drive roller 16 secured thereto. The axle 20 has on one end a drive gear 21 secured thereto and meshing with an intermediate gear 22 rotatably mounted on a stub shaft 23. A suitable motor (not shown) rotates the intermediate gear 22 to drive the axle 20 at a constant speed.

The pressure roller 18 is movable toward and away from the drive roller 16 so as to allow the distance between the axes of the rollers 16 and 18 to be adjusted. More specifically, the frames 14 have a pair of blocks 24 fixed thereto and located beneath the ball bearings 19, the blocks 24 are rectangular frames defining rectangular slots in which bearings 25 and slides 26 slidably move. The axle 27 is journalled in bearings 25 and supports the pressure roller 18 rotatably thereon through ball bearings 28. The axle 27 is an eccentric shaft having a central portion **28*a* eccentric to both ends of the axle 27 supported in the bearings 25. Each of the slides 26 is internally threaded centrally in the vertical direction and has an externally threaded rod or shaft 29 screwed therein. The shafts 29 have bottom ends 30 extending downwardly through openings in the frames 24** and having worm wheels 31 secured thereto. Beneath the blocks 24, there is provided a worm gear shaft 32 rotatably supported in the frames 14 and having on its ends a pair of worms 33 mounted for corotation therewith and meshing with the worm wheels 31. A handwheel 34 is mounted on one end of the worm gear shaft 32 for rotating the latter. The axle 27 is provided on one end with a gear wheel 35 affixed thereto and meshing with a drive shaft 36 of a register motor 37 mounted on the table 15.

The die roll station 11 is located downstream of the feeding apparatus 13 and comprises a cutter roller 38 and an anvil roller (not shown) disposed beneath and held in rolling contact with the cutter roller 38. The cutter roller 38 has an axle 39 journaled in a pair of bearings 40 supported movably on the frame 14, the axle 39 being rotatable by means of a suitable motor (not shown). The anvil roller has an axle 41 journaled in a pair of bearings 42 fixed to the frames 14. The bearings 40 are vertically movable by means of a pair of adjustment screws 43 threaded through top members 44 mounted on the frames 14 in order to enable the cutter roller 38 to be moved toward and away from the anvil roller. A pulse generator 45, shown in dotted lines in FIG. 2, is operatively connected to the cutter roller 38 and has therein a pair of photoelectric circuits capable of generating a pair of pulses successively in synchronism with the rotation of the cutter roller 38. The pulses generated by the pulse generator 45 are fed to a control device 46, shown also in dotted lines, for controlling the speed of rotation of the register motor 37.

An inclined plate 47 is located upstream of the feed apparatus 13 and supported by a pair of arms 48 on the frames 14, the inclined plate 47 being provided for receiving and guiding the elongate sheet member 12. The inclined plate 47 is provided on its undersurface with a pair of scanning heads 49 each internally housing a photoelectric tube, an amplifier and other devices. A pair of apertures 50 are formed in the guide plate 47 and positioned above the scanning heads 49 enabling the scanning heads 49 to detect through the apertures 50 register marks (not shown) printed at spaced intervals along the length of the continuous sheet 12 which is traveling slidably on the guide plate 47. The scanning heads 49, upon detection of the register marks, generate pulses which are then fed to the control device 46.

When the elongate sheet 12 is to be threaded into the nip of the feed apparatus 13, the sheet 12 is unwound from a roll, directed onto the guide plate 47 and inserted between the drive roller 16 and the pressure roller 18 which are spaced from each other. Then, the handwheel 34 is turned to rotate the worm gear shaft 32 and the worms 33 mounted thereon. The worm wheels 31 are rotated by the worms 33 to rotate the shafts 29 so as to raise the slides 26 and the bearings 25 slidably within the block frames 24. The pressure roller 18 is thus moved upwardly into engagement with the drive roller 16 with the sheet material 12 interposed therebetween. The drive roller 16 is rotated at a constant speed by the motor through the drive gear 21 and the intermediate gear 22 to feed the continuous sheet 12 sandwiched between the rollers 16 and 18 continuously from the sheet roll to the die roll station 11.

Figure 4:
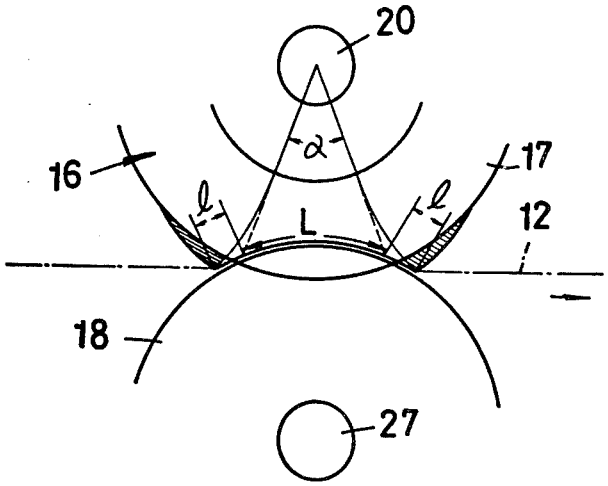
FIG. 4 is a schematic cross-sectional view of drive and pressure rollers biased together.

The die roll station 11 serves to stamp out the continuous sheet 12 is conformity with blank patterns such as container walls printed on the sheet 12. In order to bring the punched blanks into precise registry with the printed patterns on the sheet 12, the speed of travel of the continuous sheet 12 is controlled by changing the distance between the axes of the drive roller 16 and the pressure roller 18. More specifically, as shown in FIG. 4, the drive roller 16 and the pressure roller 18 feed the continuous sheet member 12 sandwiched therebetween at a constant speed of travel, the length of a peripheral deformed surface of the resilient cover 17 which bears against the pressure roller 18 being L subtending an angle $\alpha$. With the pressure roller 18 raised, that is; with the interaxial distance between the rollers 16 and 18 decreased, the length of a contacting peripheral surface of the resilient roll cover 17 becomes increased by a length of two l's, the resulting length $(L+2l)$ still subtending the angle $\alpha$. Since the drive roller 16 has a constant rotational speed, the peripheral speed of the drive roller 16 at the peripheral surface which abuts against the pressure roller 18 is increased, so that the elongate sheet 12 held in contact between the rollers 16 and 18 is fed at a higher speed.

The mode of operation by which the interaxis distance between the rollers 16 and 18 is varied will be described below. While the die roll machine 10 is operated, the pulses coming from the scanning heads 47 and the pairs of pulses from the pulse generator 45 are compared with each other within the control device 46 and, if the speed of feeding of the sheet member 12 is out of synchronism with the speed of operation of the die roll station 11, the control device 46 actuates the register motor 37 which in turn rotates the gear wheel 35. The gear wheel 35, when rotated, turns the eccentric axle 27 to thereby move the pressure roller 18 toward or away from the drive roller 16. When the speed at which the elongate sheet 12 is fed is less than that at which the cutter roller 38 punches the sheet 12, the register motor 37 is actuated to rotate the gear wheel 35 in such a direction that the pressure roller 18 is elevated to bear against the drive roller 16 under a higher pressure of contact. With the interaxial distance between the rollers 16 and 18 thus decreased, the speed of travel of the continuous sheet material 12 is increased, as mentioned before, until it becomes synchronous with the speed at which the sheet 12 is processed at the die roll station 11. Conversely, when the speed at which the elongate sheet member 12 is fed is higher than that at which the cutter roller 38 punches the sheet member 12, the control device 46 signals the register motor 37 to rotate the gear wheel 35 in the opposite direction so that the pressure roller 18 is lowered to decrease the force with which the pressure roller 18 bears against the drive roller 16. Thus, the peripheral surface of the drive roller cover 17 which is held in contact with the pressure roller 18 is reduced in size and the peripheral speed at the contacting peripheral surface is decreased accordingly. The speed of travel of continuous sheet 12 is reduced until it comes into synchronism with the speed of operation of the die roll station 11.

Figure 5:
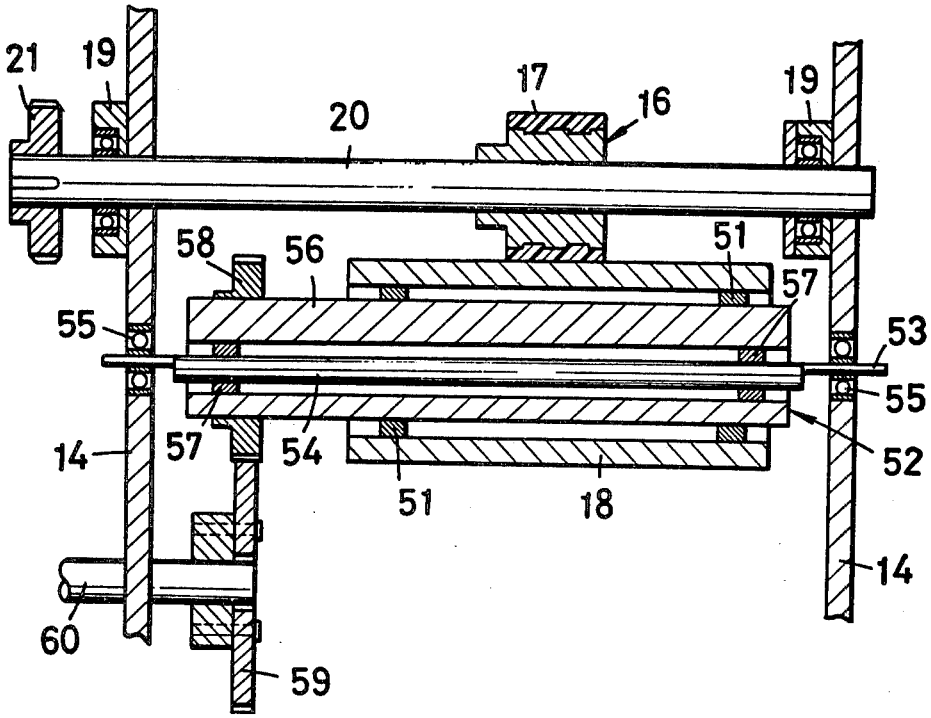
FIGS. 5 and 6 are fragmentary cross-sectional views showing other preferred embodiments of the pressure roller.

FIG. 5 shows another preferred embodiment of means for varying the interaxial distance between the drive roller 16 and the pressure roller 18. The pressure roller 18 is rotatably mounted by a pair of bearings 51 on a dual axle construction 52 which comprises an inner eccentric axle 53 journaled in a pair of ball bearings 55 mounted in the frames 14 and having an eccentric central portion 54, and an outer eccentric axle 56 rotatably mounted by a pair of bushings 57 on the eccentric central portion 54 of the inner axle 53, the outer axle 56 being eccentric to the inner axle 53. The outer eccentric axle 56 has on one end a gear 58 secured thereto and meshing with a gear wheel 59 mounted fixedly on a shaft 60 coupled to a suitable drive mechanism (not shown), such as the register motor 37. With this construction, the continuous sheet 12 is first inserted between the drive and pressure rollers 16 and 18 which are initially spaced apart from each other and the pressure roller 18 is then raised into abutment with the sheet 12 and the drive roller 16 by rotating the inner eccentric axle 53 manually or automatically. The force of contact by the pressure roller 18 on the drive roller 16 can be varied by rotating the outer eccentric axle 56 by means of the drive mechanism through the gear 58 and gear wheel 59 for the purpose of changing the speed at which the sheet 12 is fed.

Figure 6:
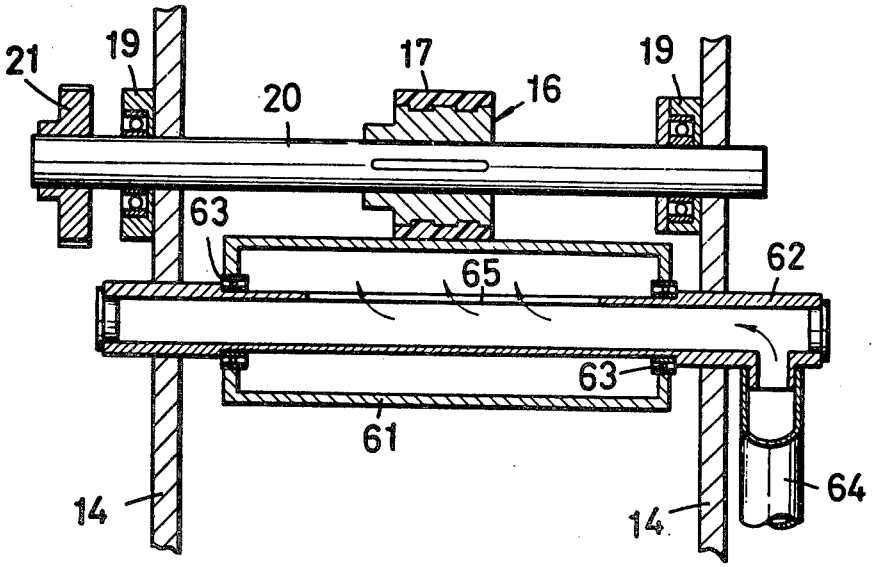

Still another embodiment shown in FIG. 6 comprises a hollow resilient pressure roller 61 rotatably mounted on a hollow shaft 62 by a pair of ball bearings 63 provided at both ends of the pressure roller 61, the hollow shaft 62 being fixed to the frames 14 and connected near one end with a suitable supply of air or oil, such as an accumulator, by a conduit 64. The hollow shaft 62 has both ends closed off and has a plurality of apertures 65 formed therethrough for communication with the hollow pressure roller 61. The force of contact of the pressure roller 61 on the drive roller 16 can be increased by applying fluid pressure on the inside wall of the hollow roller 61, the applied fluid pressure acting to expand the pressure roller 62 in its radial direction, thereby feeding the continuous sheet 12 at a higher speed.

An experimental test was conducted to confirm the fact that the speed at which the continuous sheet 12 is fed is inversely proportional to the distance between the axes of the drive and pressure rollers 16 and 18. The physical characteristics of the component parts used were as follows:

Drive roller: made of rubber. The diameter was 90.5 mm. The hardness of rubber was 70. The thickness of the blanket was 13 mm.

Pressure roller: made of iron. The diameter was 80 mm.

Cutter roller: made of iron. The diameter was 74.5 mm (including the height of the cutter blade).

Anvil roller: made of iron. The diameter was 74.5 mm.

The gear ratio of the drive roller: cutter roller: anvil roller was 63:50:50.

Figure 7:
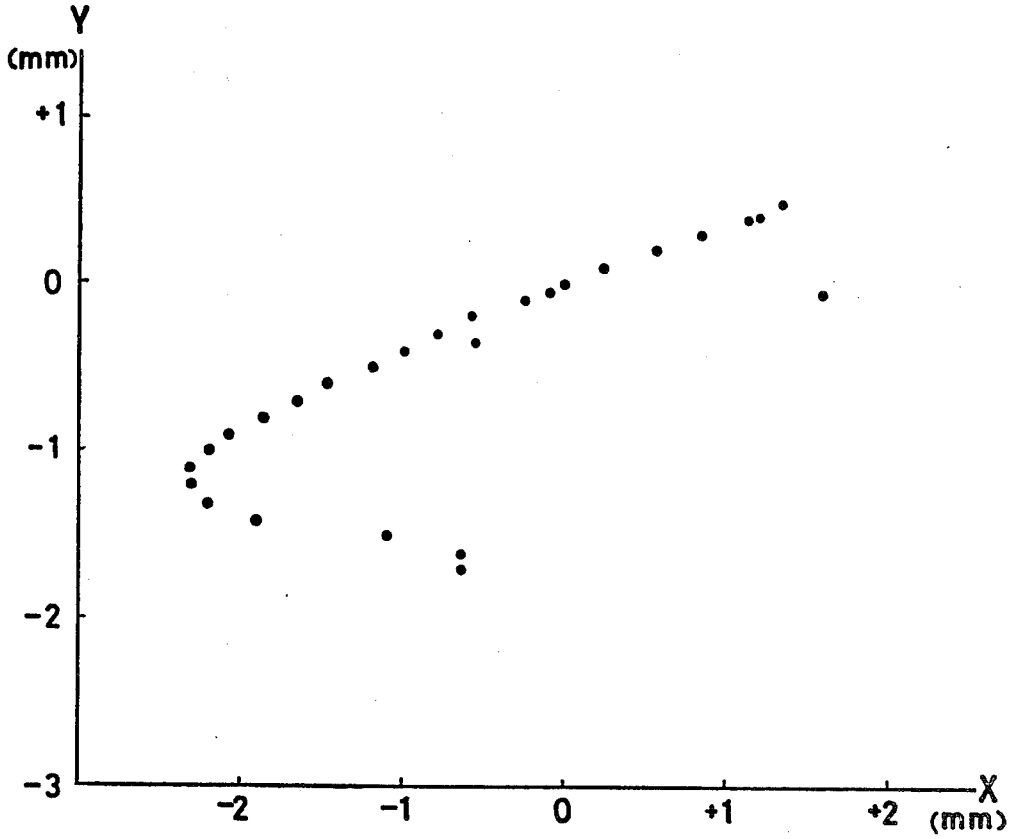
FIG. 7 is a graph showing the relation between the interaxial distance between the drive and pressure rollers and the speed of travel of an elongate sheet material which is being fed by the rollers.

In FIG. 7, an axis X indicates the amount of misregistration between the punched patterns and the printed patterns on the elongate sheet 12. The point of 0 on the axis X indicates no misregistration, which means that the speed at which the sheet is fed is synchronous with that at which the sheet is stamped out. As the amount of misregistration increases rightward from the point 0, or as the amount of misregistration decreases rightward to the point of 0, the speed of travel of the continuous sheet becomes progressively higher. An axis Y indicates the amount of variation of the interaxial distance between the drive and pressure rollers, the point of 0 being an interaxial distance when there is no misregistration between the punched and printed patterns on the continuous sheet. The results of the experimental test are shown in FIG. 7 in which the data represent every sixth specimen of the punched patterns. FIG. 7 clearly indicates that as the interaxial distance is reduced in order to increase the force of contact between the drive and pressure rollers, the speed of travel of the elongate sheet is increased. Conversely, as the interaxis is increased, the speed of travel of the continuous sheet is slowed to a point beyond which the feeding speed is increased again. This increase of the feeding speed is caused by the fact that the drive and pressure rollers, when spaced apart excessively, can no longer grip the continuous sheet therebetween, whereupon the drive roller starts slipping on the sheet. The continuous sheet is then pulled forward by the rotating cutter roller at an increasingly higher speed.

Although the invention has been disclosed with reference to preferred embodiments thereof, it is to be understood that various modifications may be made to such embodiments without departing from the scope of the appended claims.

What we claim is:

1. An apparatus for feeding an elongated sheet material, comprising:

a rotatable drive roller, said drive roller having a resilient cylindrical surface;

a frame for supporting said drive roller;

means for rotating said drive roller;

a pressure roller cooperative with said drive roller to form a nip therebetween for receiving and feeding the elongated sheet material;

means for variably biasing said pressure roller and said drive roller together, including an axle having a central portion supporting said pressure roller thereon and a pair of journal portions eccentric to said central portion, said pressure roller being movable toward and away from said drive roller by rotation of said axle, and a motor for rotating said axle; and control means for operating said biasing means, including means for detecting the speed of travel of the elongated sheet and means for actuating said motor in response to changes in the speed of travel of the elongated sheet, whereby the periphery of said resilient cylindrical surface can be deformed and reduced in size as the biasing force is increased, thereby varying the speed at which the elongated sheet material is fed.

2. An apparatus for feeding an elongated sheet material, comprising:

a rotatable drive roller, said drive roller having a resilient cylindrical surface;

a frame for supporting said drive roller;

means for rotating said drive roller;

a pressure roller cooperative with said drive roller to form a nip therebetween for receiving and feeding the elongated sheet material;

means for variably biasing said pressure roller and said drive roller together, including an axle having a central portion supporting said pressure roller thereon and a pair of journal portions eccentric to said central portion, said pressure roller being movable toward and away from said drive roller by rotation of said axle; and means for moving said axle toward and away from said drive roller, including a pair of bearings supporting therein said journal portions of said axle and a pair of slide members slidably mounted on said frame and supporting said bearings, whereby the periphery of said resilient cylindrical surface can be deformed and reduced in size as the biasing force is increased, thereby varying the speed at which the elongated sheet material is fed.

3. The apparatus of claim 2 wherein each of said slide members is provided with an internally threaded hole and further comprising:

a screw member fitted within said threaded hole at one end and secured to a worm wheel at the opposite end; and a shaft having a pair of worms secured thereto in meshing relationship with the worm wheels, said slide members carrying said bearings being movable by rotation of said shaft.

4. An apparatus for feeding an elongated sheet material, comprising:

a rotatable drive roller, said drive roller having a resilient cylindrical surface;

means for rotating said drive roller;

a pressure roller cooperative with said drive roller to form a nip therebetween for receiving and feeding the elongated sheet material; and means for variably biasing said pressure roller and said drive roller together, including an inner axle and an outer axle rotatably supported on said inner axle, said pressure roller being rotatably mounted on said outer axle, said outer axle being eccentric to said inner axle, whereby said pressure roller is movable toward and away from said drive roller by rotation of said outer axle on said inner axle, the periphery of said resilient cylindrical surface being deformed and reduced in size as the biasing force is increased, thereby varying the speed at which the elongated sheet material is fed.

* * * * *

UNITED STATES PATENT AND TRADEMARK OFFICE

CERTIFICATE OF CORRECTION

PATENT NO. : 4,158,429

DATED : June 19, 1979

INVENTOR(S) : KOICHIRO OHMORI

It is certified that error appears in the above-identified patent and that said Letters Patent are hereby corrected as shown below:

Column 1, line 38, before "continuous" insert --the--.

Column 3, line 65, delete "is" and insert --in--.

Column 4, line 13, delete "l's" and insert --ℓ's--; same line, delete "(L-21)" and insert --(L-2ℓ)--.

Column 5, line 60, delete "data" and insert --dots--.

Signed and Sealed this

Sixth Day of November 1979

[SEAL]

Attest:

RUTH C. MASON
Attesting Officer

LUTRELLE F. PARKER
Acting Commissioner of Patents and Trademarks